US010034087B2

(12) United States Patent
Ambrose et al.

(10) Patent No.: US 10,034,087 B2
(45) Date of Patent: Jul. 24, 2018

(54) AUDIO SIGNAL PROCESSING FOR LISTENING DEVICES

(71) Applicant: ASIUS TECHNOLOGIES, LLC, Longmont, CO (US)

(72) Inventors: Stephen D. Ambrose, Longmont, CO (US); Samuel P. Gido, Hadley, MA (US)

(73) Assignee: ASIUS TECHNOLOGIES, LLC, Longmont, CO (US)

( * ) Notice: Subject to any disclaimer, the term of this patent is extended or adjusted under 35 U.S.C. 154(b) by 0 days.

(21) Appl. No.: 14/438,813

(22) PCT Filed: Oct. 28, 2013

(86) PCT No.: PCT/US2013/067152
§ 371 (c)(1),
(2) Date: Apr. 27, 2015

(87) PCT Pub. No.: WO2014/066914
PCT Pub. Date: May 1, 2014

(65) Prior Publication Data

US 2015/0304774 A1 Oct. 22, 2015

Related U.S. Application Data

(60) Provisional application No. 61/719,119, filed on Oct. 26, 2012.

(51) Int. Cl.
*H04R 1/10* (2006.01)
*H04R 3/04* (2006.01)
(Continued)

(52) U.S. Cl.
CPC ..... *H04R 3/04* (2013.01); *H04R 1/10* (2013.01); *H04R 1/1091* (2013.01); *H04R 5/033* (2013.01); *H04R 25/505* (2013.01)

(58) Field of Classification Search
CPC ..... H04R 3/04; H03G 5/165; H03G 3/20
(Continued)

(56) References Cited

U.S. PATENT DOCUMENTS 5,481,615 A 1/1996 Eatwell et al.
8,774,433 B2 7/2014 Goldstein
(Continued)

FOREIGN PATENT DOCUMENTS

EP 2 056 624 4/2008

OTHER PUBLICATIONS

International Search Report for PCT/US2013/067152, dated Feb. 14, 2014.

*Primary Examiner* — Alexander Jamal
(74) *Attorney, Agent, or Firm* — Marvin Petry; Stites & Harbison PLLC

(57) ABSTRACT

A method of mitigating effects of alternating or changing pneumatic pressures within a substantially sealed ear canal includes providing an indication of ear canal sound pressure level associated with sound for an audio program produced by a corresponding audio listening device substantially sealing an ear canal to form a substantially trapped volume; and performing audio signal processing on the audio program based on the indication of ear canal sound pressure level using a predetermined frequency response curve for the audio listening device to mitigate effects of pneumatic pressure within the ear canal.

12 Claims, 5 Drawing Sheets

(51) Int. Cl.
*H04R 5/033* (2006.01)
*H04R 25/00* (2006.01)

(58) Field of Classification Search
USPC ..... 381/74, 71.14, 71.11, 103
See application file for complete search history.

(56) References Cited

U.S. PATENT DOCUMENTS

| | | | | |
|---|---|---|---|---|
| 2007/0274531 | A1 | 11/2007 | Camp | |
| 2008/0144841 | A1 | 6/2008 | Goldstein et al. | |
| 2013/0094657 | A1* | 4/2013 | Brammer ..... | G10K 11/1788 381/71.6 |

* cited by examiner

AUDIO SIGNAL PROCESSING FOR LISTENING DEVICES

CROSS-REFERENCE TO RELATED APPLICATIONS

The present application claims filing priority to U.S. Provisional Application No. 61/719,119, filed Oct. 26, 2012. The present application is related to U.S. application Ser. No. 13/288,515, titled "Audio Device, System and Method," filed on Nov. 3, 2011 and published as Publication No. 2012/0217087 A1 on Aug. 30, 2012. The present application is also related to U.S. application Ser. No. 13/222,943, titled "Hearing Device System and Method" and filed on Aug. 31, 2011, as well as U.S. application Ser. No. 13/086,138, titled "Inflatable Bubble," filed Apr. 13, 2011. In addition, the present application is also related U.S. application Ser. No. 12/777,001, to Ambrose et al. and titled "Inflatable Ear Device," filed on May 10, 2010 and published as Publication No. 2010/0322454 A1 on Dec. 23, 2010, which is a continuation-in-part of U.S. application Ser. No. 12/178,236, to Ambrose et al. and titled "Diaphonic Acoustic Transduction Coupler and Ear Bud," filed on Jul. 23, 2008 and published as Publication No. 2009/0028356 A1 on Jan. 29, 2009. The complete content of each of the above-listed applications is hereby incorporated by reference.

BACKGROUND OF THE INVENTION

Exemplary embodiments of the present invention relate to processing of audio signals that are output as sound by audio listening devices. More specifically, exemplary embodiments relate to audio signal processing that is performed to reduce or mitigate audio fatigue resulting from use of audio listening devices.

With the invention of the professional in-ear, stage and studio, monitoring systems in the 1970's, large numbers of people began to experience the sealing of high fidelity speakers to the ear canal for the first time. These devices have protected hundreds of thousands of amateur and professional musicians and sound engineers from hearing loss due to excessive performance volumes. Nevertheless, in-ear monitors have been, and remain, a persistent source of audio fatigue and potential short term or long term hearing loss. They share this problem with other in-ear listening devices such as hearing aids, insert headphones, ear buds, and the like, as well as headphones and other over-ear devices that are designed to hold small loudspeakers in place close to a user's ears. Professional applications of in-ear monitors have called for some musicians and sound engineers to tolerate conditions of persistent audio fatigue, in which peoples' ears begin to physically ache or hurt after prolonged use of in-ear devices, which can become nearly intolerable by the end of a performance or recording session. These users often refer to a sensation of percussiveness beating their ears that cannot be eliminated by simply turning down the volume.

Almost every person has experienced a situation where the volume from another person's headphones could be heard even from across a room, on a bus, in a store, or any number of public venues. Given the sound volume necessary to be heard at a distance, the volume blasting directly into a listener's ear in such a situation can be expected to be excessive. The listener might be asked (or admonished) to turn down their headphones for the sake of their own health and for the courtesy to others, but what has not been hitherto widely realized is that the person listening to the headphones has already, unknowingly turned down their own personal perception of the volume through a natural hearing protection mechanism known as the acoustic reflex. The acoustic reflex is a natural mechanism involving an involuntary muscle contraction that occurs in the middle ear in response to high-intensity sound stimuli. By way of the acoustic reflex, contraction of the stapedius muscle in the ear reduces the ear's sensitivity in order to protect itself from being damaged by loud noises and to widen its dynamic range to higher sound pressure levels.

The persistent triggering of this reflex by insert headphones, hearing aids, and the like, may perpetuate a cycle in which the user continually increases the volume to counteract the effects of the acoustic reflex. This can also set up an additional dangerous situation for a user who is already tolerating very loud volumes due to the acoustic reflex and accidentally or intentionally turns the volume up even further at a point at which the stapedius muscle has already become exhausted or reached a limit of its inherent ability to protect the ear from loud sounds and temporary or even permanent hearing loss.

SUMMARY OF THE INVENTION

Exemplary embodiments of the present invention are related to a method of mitigating effects of alternating or changing pneumatic pressures within a substantially sealed ear canal. The method includes providing an indication of ear canal sound pressure level associated with sound for an audio program produced by a corresponding audio listening device substantially sealing an ear canal to form a substantially trapped volume; and performing audio signal processing on the audio program based on the indication of ear canal sound pressure level using a predetermined frequency response curve for the audio listening device to mitigate effects of pneumatic pressure within the ear canal.

Exemplary embodiments of the present invention that are related to computer program products and data processing systems corresponding to the above-summarized method are also described and claimed herein.

The above-described and other features and advantages of the present disclosure will be better appreciated and understood by those skilled in the art with reference to the following detailed description, drawings, and appended claims. Additional features and advantages are realized through the techniques of the present invention. Other embodiments and aspects of the invention are described in detail herein and are considered a part of the claimed invention.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description of exemplary embodiments of the present invention taken in conjunction with the accompanying drawings in which:

Figure 1:
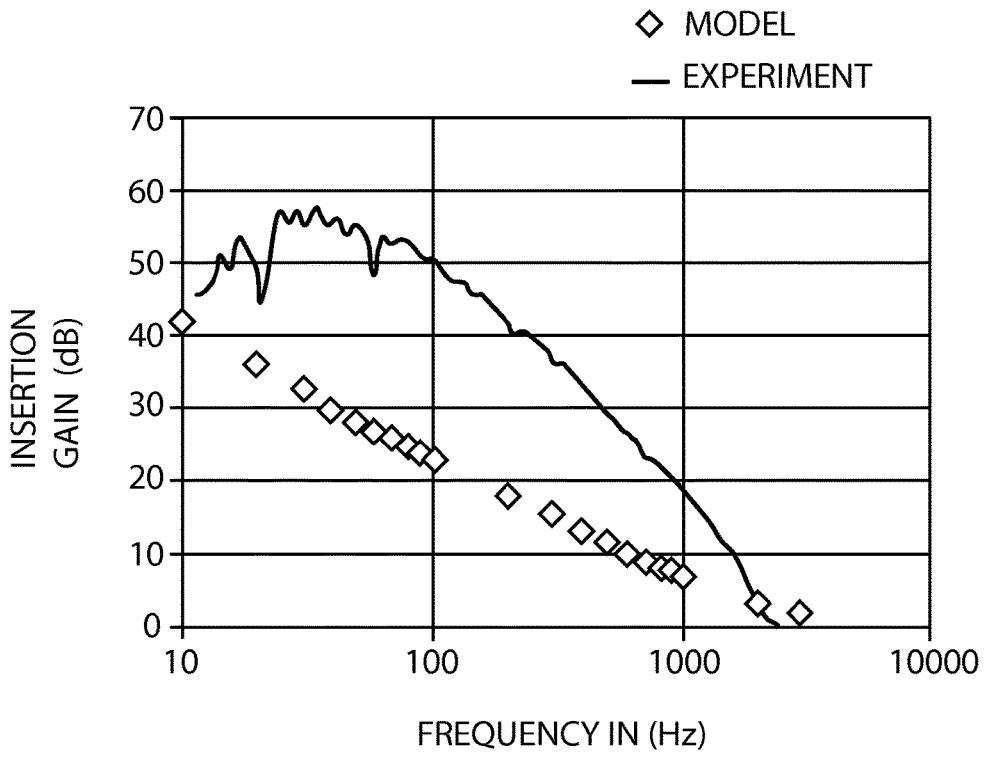
FIG. 1 is a diagram illustrating a graph plotting example experimentally-determined Trapped Volume Insertion Gain (TVIG) data alongside a mathematical modeling of TVIG calculated based on oscillating static pressure in a sealed ear canal against frequency in accordance with an exemplary embodiment of the present invention.

The detailed description explains exemplary embodiments of the present invention, together with advantages and features, by way of example with reference to the drawings, in which similar numbers refer to similar parts throughout the drawings. The flow diagrams depicted herein are just examples. There may be many variations to these diagrams or the steps (or operations) described therein without departing from the spirit of the invention. For instance, the steps may be performed in a differing order, or steps may be added, deleted, or modified. All of these variations are considered to be within the scope of the claimed invention.

DETAILED DESCRIPTION

While the specification concludes with claims defining the features of the invention that are regarded as novel, it is believed that the invention will be better understood from a consideration of the description of exemplary embodiments in conjunction with the drawings. It is of course to be understood that the embodiments described herein are merely exemplary of the invention, which can be embodied in various forms. Therefore, specific structural and functional details disclosed in relation to the exemplary embodiments described herein are not to be interpreted as limiting, but merely as a representative basis for teaching one skilled in the art to variously employ the present invention in virtually any appropriate form, and it will be apparent to those skilled in the art that the present invention may be practiced without certain specific details. Further, the terms and phrases used herein are not intended to be limiting but rather to provide an understandable description of the invention. As used herein, the singular forms "a", "an", and "the" are intended to include the plural forms as well, unless the content clearly indicates otherwise. It will be further understood that the terms "comprises", "includes", and "comprising", when used in this specification, specify the presence of stated features, integers, steps, operations, elements, components, and/or groups thereof.

As outlined in significant detail in related U.S. patent application Ser. No. 13/288,515 ("Patent Document 1"), the content of which is incorporated by reference thereto in its entirety herein, a problem associated with a boost in sound pressure level can arise through use of personal listening devices that are designed to hold small audio speakers in place close to or within a user's ears in a manner in which the ear canal is sealed or substantially sealed by the listening device. This problematic boost can be particularly dramatic when using personal listening devices that comprise small headphones that are fitted directly in and sealed within the ear such as, for example, earbuds, insert headphones, professional in-ear monitors, and hearing aids.

In particular, as explained in Patent Document 1, audio speakers, when inserted into the human ear, produce large oscillations in pressure within the ear canal, even when the speakers are operated at what would typically be considered modest output levels. These large pressures in the sealed volume of the ear canal translate into high sound pressure levels that trigger the acoustic reflex, with the resulting reduction in hearing sensitivity having the potential to diminish the quality of audio perception through in-ear audio devices.

More specifically, as shown in Patent Document 1, the acoustic, standing waves produced from a speaker in the ear canal are physically and mathematically equivalent to a static pressure, akin to the air pressure confined within an inflated balloon or the static pressure employed in tympanometry. Unlike the static pressures normally encountered, however, the magnitude of this static pressure in a sealed ear canal is oscillating at acoustic frequencies. This oscillating static pressure results from the trapping of a closed volume of air in the ear canal when the sound producing device is sealed in the ear. Such oscillating static pressures, which can also be described as alternating or changing pneumatic pressures, are high in amplitude and sound pressure level and are as much as 90 or more degrees out of phase with the velocity component of otherwise unsealed sound waves. Such pneumatic pressures are responsible for gross over-excursions of the tympanic membrane (that is, the eardrum) that can be one hundred or one thousand or more times greater than the normal oscillations of the ear drum associated with sound transmitted through the open air.

When sealed in the ear, the motion of the speaker diaphragm produces a set of static pressure oscillations, which are 90 degrees out of phase with equivalent open air sound waves. These static pressure oscillations in the sealed ear canal are also 90 degrees out of phase with the oscillating particle-velocity component of the waves, whereas they would be in phase with the velocity component were the waves occurring in open air. Especially at lower and mid-range frequencies, the static pressure oscillations in the sealed ear canal produce a large boost in the sound volume transmitted to the tympanic membrane. Just as the open-air acoustical wave spectrum can contain the superposition of different sound waves at different frequencies, the corresponding static pressure oscillations in a sealed volume, such as the ear canal, superpose to form a spectrum of co-existing static pressure oscillations with a range of frequencies.

The large amplitude static pressure oscillations, which are primarily associated with the lower frequency and/or greatest amplitude motions of the speaker, produce an effect that is referred to herein as Trapped Volume Insertion Gain (TVIG). TVIG is related to insertion gain as measured and used by the audio and hearing aid industries. TVIG is defined as the increase in sound pressure level (SPL) resulting from the static pressure oscillations in the ear canal across all frequencies that occurs when a speaker containing device seals or is sealed in the ear. It is measured relative to the SPL in the ear canal when the device is held in approximately the same position at the entrance to the ear canal, but is not sealed with an air-tight seal. In this unsealed reference state, the sound waves in the ear are not equivalent to static pressures. As shown in Patent Document 1, the trapped volume insertion gain of insert headphones, in-ear monitors, or hearing aids is often sufficient to boost the SPL experienced by the listener above the threshold at which the acoustic reflex reduces hearing sensitivity. It is possible that trapped volume insertion gain, which is operating continuously as long as the device is sealed in the ear canal, causes the stapedius muscle to remain in a continuously clenched state. As this is not a normal condition for the stapedius muscle, such trapped volume insertion gain may significantly contribute to and even be the primary cause of listener fatigue that arises from prolonged use of in-ear devices.

The gross over-excursions of the tympanic membrane, produced by sealing a sound producing device in the ear, occur despite the best efforts of the clenched stapedius muscle to limit their amplitude. The tympanic membrane moves in response to the full static air pressure compression resulting from the motion of the speaker diaphragm. These maximum static pressures are never realized in the ear canal because the tympanic membrane moves to relieve the pressure even as it is building in magnitude. The total motion of the tympanic membrane, however, is the motion that would be driven by the maximum pressure, and, thus, the tympanic membrane, and the listener, experience a larger TVIG associated with the SPL equivalent of the maximum theoretical pressures generated by the speaker motion.

The trapped volume pressure, and trapped volume insertion gain, along with their influence on the acoustic reflex, have not been widely appreciated or acknowledged by audio science or industry. As such, their potential long term damaging impacts on human hearing have not been studied. Because this trapped volume insertion gain phenomena can lead to dramatic over-excursions of the tympanic membrane, can trigger the acoustic reflex (temporarily lessening hearing sensitivity), and can contribute to audio (listener) fatigue, it is thus hypothesized that, through repeated exposure, the pressure-driven pounding may also contribute to long-term hearing damage that popular opinion and recent study attribute to the use of in-ear listening devices. In other words, the SPL gains associated with sealing a personal listening device in the ear may lead to temporary and eventually to permanent hearing threshold shifts indicating a loss of hearing sensitivity.

FIG. 1 is a graph plotting experimentally-determined TVIG data alongside a mathematical modeling of TVIG calculated based on oscillating static pressure in a sealed ear canal against frequency to illustrate the increase in SPL in the ear canal between a sealed speaker condition and open-air SPL with the same speaker driven with the same voltage and current but not sealed. The values used for open-air SPL represent the acoustic sound waves that coexist in the ear canal with the static pressure waves. Thus, at each frequency, the TVIG is the difference between the total SPL in the sealed ear canal, including the effect of static pressure oscillations, minus the SPL due only to acoustical waves, which is the same as the open air SPL for which would result from the same speaker motion.

Although the static pressure gain, or TVIG, is frequency dependent, TVIG is a constant or approximately constant addition to open-air SPL at a given frequency, regardless of how large or small this open-air SPL is. As shown in FIG. 1, below frequencies of about 2000-3000 Hz, the oscillating static pressure boosts the overall SPL in the ear canal above the level associated with the acoustic waves, and this static pressure boost decreases with increasing frequency. This increased sound pressure level in the sealed ear canal becomes more dramatic at frequencies below about 2 kHz.

Exemplary embodiments of mechanisms to reduce, eliminate, and/or mitigate the effects of amplitude pressure oscillations that result when a sound producing device is sealed in the ear canal in accordance with the present invention will now be described with reference to the drawings. As described in greater detail below, exemplary embodiments of the present invention can be implemented to lessen the impact of tympanic membrane over-excursions, oscillating static pressure in the ear canal, trapped volume insertion gain, and the constant triggering of the acoustic reflex for in-ear listening devices. Exemplary embodiments can thus be utilized to alleviate a range of deleterious effects on the quality of the listening experience, listener comfort, and potentially long term health produced by amplitude pressure oscillations resulting when a sound producing device is sealed in the ear canal.

Exemplary embodiments of the present invention can be implemented to provide mechanisms that are applicable for personal listening devices such as earbuds, headphones, in-ear monitors, hearing aids, headsets, and the like that convert electrical audio signals into sound. In exemplary embodiments, such devices may utilize wires for connection to an audio signal source (such as those using 6.35 mm and 3.5 mm phone connectors) and/or comprise powered wireless receivers for picking up signals transmitted wirelessly from an audio signal source (such as those using receiving a radio or infrared signal encoded using a radio or infrared transmission link, like FM, Bluetooth, or Wi-Fi). Exemplary embodiments can be implemented for use with or incorporated within any suitable source of audio signals such as, for example, audio amplifiers, radios, CD or DVD players, home theater equipment, personal computers, portable media players such as digital audio or mp3 players, mobile phones, and the like.

Figure 2:
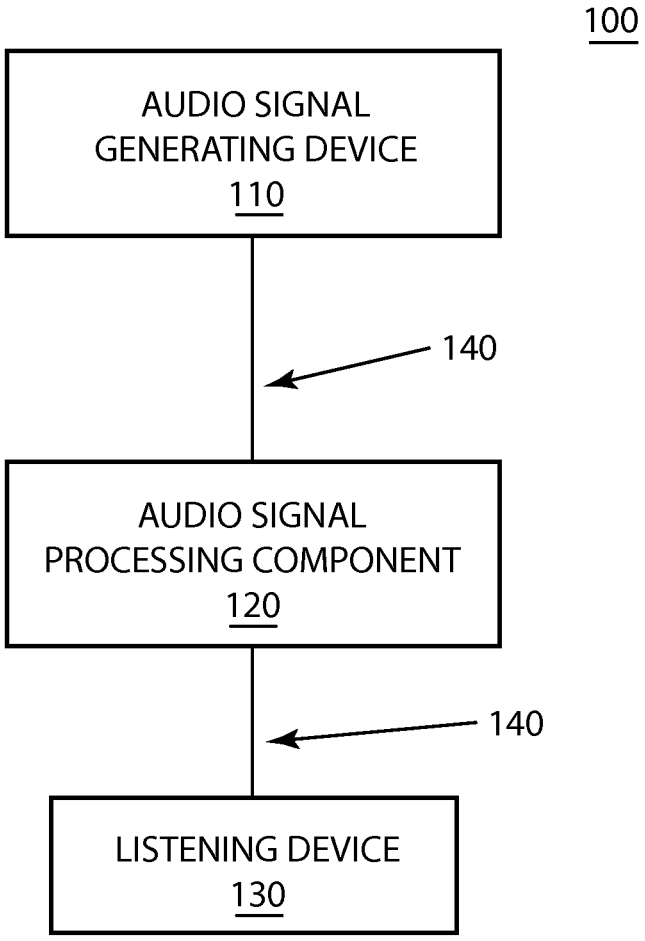
FIG. 2 is a schematic diagram illustrating an electronic audio listening system in accordance with an exemplary embodiment of the present invention.

Referring now to FIG. 2, a schematic diagram illustrating an electronic audio listening system within which exemplary embodiments of the present invention may be implemented is provided. It should of course be understood that FIG. 2 is intended as an example, not as an architectural limitation for different embodiments of the present invention, and therefore, the particular elements depicted in FIG. 2 should not be considered limiting with regard to the environments within which exemplary embodiments of the present invention may be implemented.

In the exemplary embodiment illustrated in FIG. 2, system 100 generally includes an audio signal generating device 110, an audio signal processing component 120, and an in-ear listening device 130. Audio signal generating device 110 is configured to generate an electrical audio signal (for example, representing music or speech) and transmit the audio signal along an audio signal flow 140 for reception by listening device 130. Listening device 130 is configured to receive the audio signal and convert the audio signal into a sound output. In the present exemplary embodiment, for outputting the audio signal as sound, listening device 130 comprises a pair of small loudspeakers that are designed to be held in place within a user's ears for listening to the audio signals. As will be explained in greater detail below, audio signal processing component 120 is implemented along signal flow 140 and configured to perform audio signal processing on the audio signal being transmitted to the listening device during playback for the purpose of reducing or mitigating trapped volume static pressure oscillations and the triggering of the acoustic reflex. The audio signal may be transmitted along signal flow 140 via wires connecting audio signal generating device 110 to listening device 130 and/or a wireless communication channel between a transmitter of the audio signal generating device and a receiver of the listening device.

In exemplary embodiments, audio signal generating device 110 may comprise any of a wide range of suitable electronic devices including a portable media player such as a digital audio or mp3 player, a mobile phone, a smart phone, or other communications device, a wired telephone, a radio receiver, an audio amplifier, home theater equipment, a television, a CD or DVD player, a computer, a device generating a voice over IP signal, and the like.

In exemplary embodiments, listening device 130 may comprise any suitable device for converting electrical audio signals into sound that is directed into the ear canal while isolating this sound source from any microphones and amplification electronics which could lead to feedback such as earbuds, headphones, in-ear monitors, hearing aids, headsets, and the like. Listening device 130 may utilize an "acoustic seal" that is created by a snug fitting piece inserted into the ear. Examples of such in-ear listening devices include custom ear molds of the type used in hearing aids and in stage monitors for professional musicians. Listening device 130 may utilize a sound generating receiver (moving coil speaker or balanced armature transducer or the like) which is located in the ear canal along with the element that produces the acoustic seal. Such a configuration is known as Receiver in Canal (RIC). In alternative exemplary embodiments, listening device 130 may comprise a sound generating receiver that is located outside of the ear canal and a sound tube that directs the sound through the acoustic seal into the ear canal.

In the present exemplary embodiment, as noted above, audio signal processing component 120 is configured to perform audio signal processing on the audio signal being transmitted to listening device 130 for the purpose of reducing or mitigating trapped volume static pressure oscillations and the triggering of the acoustic reflex within the ear of the user. More specifically, signal processing component 120 is configured to, based on an indication of an amount of trapped volume insertion gain associated with the audio signal, reduce or mitigate the indicated trapped volume insertion gain electronically during playback using equalization for providing particular adjustments to alter the frequency response, or using other frequency specific sound processing or volume control mechanisms, to reduce the amplitude of the frequency components of the audio signal as it is being played in real time in the user's ear via the listening device 130.

In exemplary embodiments, signal processing component 120 is configured to tailor the frequency content of the audio signal to produce desired spectral characteristics for reducing or mitigating the indicated trapped volume insertion gain using a frequency dependent equalization curve that scales back output at each frequency in proportion to the amount of trapped volume insertion gain at that frequency. For this purpose, signal processing component 120 may comprise an equalizer or be implemented to operate in conjunction with such a circuit or equipment to achieve a desired equalization by altering the frequency response using a bank of filters to process the audio signal. Each filter passes the portion of the signal present in its own frequency range or band with a desired amplitude in the equalization implemented by signal processing component 120, and the mathematical descriptions used for configuring the responses of the filters used for the equalization curve can be determined so as to provide for adjustments to the frequency response that operate to counteract the effects of oscillating static pressure, trapped volume insertion gain, and the triggering of the acoustic reflex. For example, because pneumatic pressures are nonlinear, the bank of filters can be implemented using nonlinear filters to achieve the desired equalization for mitigating pneumatic pressures.

In exemplary embodiments, the number of frequency channels (and therefore each one's bandwidth) for configuring the filters according to the equalization curve may be matched to the requirements of the intended application. For example, because high amplitude oscillating static pressures are not simply confined to very low frequencies, listening device 130 may be configured to perform the equalization for frequencies that extend up through the prime range for voice and music. In addition, because musical content below about 2 kHz is strongly boosted in SPL yielding a distortion in the equalization of the original recording dramatically favoring, for instance, the bass over the highs when the ear-tips are sealed in the ear canal, the equalization may be implemented with more particularity with respect to lower frequency components in exemplary embodiments.

In exemplary embodiments, audio signal processing component 120 may be configured to determine the indication of the amount of trapped volume insertion gain associated with the audio signal based on which the signal processing is performed by analyzing the audio signal in accordance with a mathematical model that estimates the increase in sound pressure level in the sealed ear canal as a function of the frequency characteristics of the audio signal. The degree of trapped volume insertion gain is dependent on the acoustical compliance, or oscillating static pressure compression, of the small volume of air trapped between the ear seal and the tympanic membrane. The volume of trapped air, however, cannot be directly examined and measured in the listening device 130. Nevertheless, as described in Patent Document 1 for example, various methods may be employed to create mathematical models that estimate the characteristics this volume of trapped air and how it is interacting with the ear as a function of audio frequency. In exemplary embodiments, the models used to determine the indication of the amount of trapped volume insertion gain associated with the audio signal for signal processing component 120 may be created using any of the methods described in Patent Document 1 or any other suitable methods for such purpose.

To provide for estimating the increase in sound pressure level in the sealed ear canal as a function of the frequency characteristics of the audio signal, such a mathematical model can define a set of criteria or parameters that govern whether and to what extent sound waves in a particular medium, at a particular frequency, can be interpreted as an oscillating static pressure in a confined volume of a specific size. While not accounting for the full complexity of the natural systems being modeled, such models, by capturing a sufficient level of expected detail of the physical system, can operate to provide predictions of trends and magnitudes of responses that can be used to determine a sufficiently accurate model approximating of the amount of trapped volume insertion gain associated with the audio signal. Signal processing component 120 can then be configured to utilize a model determined in this manner to determine an approximation of the trapped volume insertion gain associated with an audio signal being played back via listening device 130 and perform appropriate equalization to scale back output of the audio signal as it is being played in real time in the user's ear via the listening device at each frequency in correspondence with indicated amount of trapped volume insertion gain at that frequency, thereby mitigating trapped volume insertion gain.

In exemplary embodiments, the particular model employed for signal processing component 120 can be created according to respective characteristics of a corresponding listening device to be used in conjunction with the signal processing component. The characteristics may include, for example, the type and/or intended application of the listening device, the speaker displacement, and values for the compliances, inertness, and impedances of the speaker. The model may also be created according to predefined values for a size of the trapped volume in an ear canal between the speaker and an ear drum and for sizes and mechanical and acoustical properties of the ear canal, the ear drum, and other middle ear structures. These parameters may be defined based on, for example, average measurements on groups of human subjects and on fitting of model calculations to data obtained from human subjects. While there is obviously variability in these parameters from individual to individual such that the parameters would not necessarily apply perfectly to any given individual, a model based on a profile of approximate average values for human subjects can provide for sufficiently accurate estimates of trapped volume insertion gain for beneficial use by signal processing component 120. Nevertheless, in alternative exemplary embodiments, signal processing component 120 can be tailored more specifically for a particular individual by defining one or more of these parameters according to respective characteristics of that individual in the particular model employed.

In alternative exemplary embodiments, the indication of an amount of trapped volume insertion gain associated with the audio signal based on which the signal processing is performed by signal processing component 120 can be implemented according to the particular characteristics of a corresponding listening device directly within the equalization curve employed by the signal processing component. Such an equalization curve can be achieved, for example, through experimental analysis of the particular characteristics of the effects of the listening device on the acoustical compliance of a volume of air trapped between the acoustical seal of the listening device and the tympanic membrane in one or more representative situations.

A non-limiting example of such an experimental analysis can be conducted for a particular listening device model by utilizing a version of the listening device model that is modified to incorporate a port that is fitted with a vent having a thin flexible membrane covering configured for reducing the impact of oscillating static pressure as disclosed in Patent Document 1. As described therein, such a covered vent may be incorporated in a listening device to reduce trapped volume insertion gain by allowing relief of static pressure build up (including both positive and negative pressures) through deformation of the flexible membrane. This deformation of the covering of the vent, which may include expansion or contraction, bowing out or bowing in, and performing these motions as vibrations at acoustical frequencies, functions to reduce pressure and SPL in the ear canal so as to reduce over excursions of the tympanic membrane and to prevent the acoustic reflex.

In other words, the incorporation of a covered vent as disclosed Patent Document 1 with a listening device that is sealed in the ear canal acts to release the compliances (that is, oscillating static pressure compressions) in the trapped volume of the ear canal. In doing so, the flexible membrane covering the vent vibrates or oscillates considerably. To this point, because the motion of the flexible membrane is dependent on exposure to a given level of static pressure and/or SPL, this motion can provide an indication of ongoing exposure to pressure or SPL. Accordingly, by performing experimental analysis in which equalization is performed for a particular listening device that is modified to incorporate such a covered vent and the frequency response curve is adjusted to minimize the motion of the flexible membrane covering the vent over the full range of frequencies, a resulting equalization curve that performs an approximately equivalent function to this covered vent can be determined based on the adjusted frequency response curve. For observing the motion of the flexible membrane covering the vent during such an analysis, strobe analysis, laser Doppler interferometry, or any other suitable method may be employed. The resulting frequency response curve from such an analysis may then be applied in the equalization curve for signal processing component 120 for use with non-modified versions of that particular model of listening device to perform a function similar to that of the covered vent for mitigating pressure and SPL in the ear canal associated with an audio signal being played back via the listening device so as to reduce over excursions of the tympanic membrane and to prevent the acoustic reflex in correspondence with the characteristics of that particular listening device.

In exemplary embodiments in which such an experimental analysis is performed for listening device 130 to determine the equalization curve that is implemented by signal processing component 120, the analysis may be conducted with respect to a suitable individual having relevant characteristics that are sufficiently representative of the general population or, alternatively, with respect to a particular individual to provide for the equalization curve that is implemented by signal processing component 120 to be tailored more specifically for that particular individual. Signal processing component 120 can be configured to utilize the equalization curve determined through such an experimental analysis to perform equalization to scale back output of the audio signal at each frequency as it is being played in real time in the user's ear via listening device 130, thereby mitigating trapped volume insertion gain in a manner that is approximately equivalent the reduction in trapped volume insertion gain that is achieved by the covered vent used in the experimental analysis.

In another alternative exemplary embodiment, system 100 can be implemented to determine the indication of an amount of trapped volume insertion gain associated with the audio signal based on which the signal processing is performed by signal processing component 120 during playback of the audio signal by listening device 130 by sensing the degree of acoustical compliance due to air compression in the ear canal and acoustic inertness due to motion of the tympanic membrane. More specifically, this degree of acoustical compliance may be sensed based on electrical characteristics of the speakers of listening device 130.

For example, the primary electrical characteristic of a speaker driver is its characteristic electrical impedance as a function of frequency. The most common driver type involves an electro-mechanical transducer that uses a coil of copper wire rigidly connected to a diaphragm (generally a cone). A speaker of this type is driven by modulated electrical current produced by an amplifier that passes through the speaker coil and then magnetizes the coil through inductance to create a magnetic field in which the coil is suspended. The electrical current variations that pass through the speaker from the amplifier are thus converted to varying magnetic forces, which move the coil and thereby the diaphragm, thus forcing the driver to produce air motion that is similar to the original signal from the amplifier. In other words, because the coil is inductive, the driver has mechanical resonances, the enclosure changes the driver's electrical and mechanical characteristics, and a passive crossover between the drivers and the amplifier contributes its own variations. The result is a load resistance that varies fairly widely with frequency as well as usually a varying phase relationship between voltage and current that also changes with frequency. Thus, impedance variations of the load with frequency translate into variation in the phase relationship between the amplifier's voltage and current outputs.

In this regard, the static pressure oscillations in a sealed ear canal result in corresponding oscillations in the density of the air in the trapped volume, which leads to oscillations in the mechanical impedance of the speaker, thereby impact the speaker's coincident production of sound waves. Thus, acoustical compliance of a volume of air trapped between the acoustical seal of listening device 130 and the tympanic membrane can be indicated by sensing the speaker impedance, which can be indicated by the current drawn for a given driving frequency and the phase shift of the speaker. Thus, in exemplary embodiments, signal processing component 120 can be configured to utilize this sensed data to approximate the trapped volume insertion gain produced through playback of an audio signal via listening device 130. The driving signal to the speaker can then be reduced using the equalization curve implemented by signal processing component 120 as a function of frequency in correspondence with indicated amount of trapped volume insertion gain, thereby reducing trapped volume insertion gain and recovering a truer frequency response for the audio signal.

In still another alternative exemplary embodiment, system 100 can be configured to determine the indication of an amount of trapped volume insertion gain associated with the audio signal based on which the signal processing is performed by signal processing component 120 during playback of the audio signal by listening device 130 by sensing the sound pressure level within the ear canal without disrupting the acoustic seal. For example, listening device 130 can be provided with a built-in feed-through port that allows a sound tube for an external probe microphone to pass through the acoustic seal without disrupting the electrical seal. The external probe microphone and sound tube employed in such embodiments can be of any type suitable for measuring sound pressure the sound pressure level within the ear canal.

As another example, to provide for a more direct and realistic measurement of the sound pressure level within the ear canal, rather than utilizing such a built-in feed-through port in listening device 130 to provide a long sound tube for an external microphone, the external microphone and tube leading to it can be replaced by an internal microphone that is located beyond the seal within the sealed ear canal. More specifically, the wire connection to the internal microphone can be passed through the feed-through port without disrupting the acoustic seal to allow for the internal microphone to directly sense the sound pressure level within the ear canal and provide the sensed pressure level as a feedback signal to signal processing component 120. Accordingly, in such exemplary embodiments, signal processing component 120 can be configured to utilize this direct sensing of the sound pressure level as the indication of trapped volume insertion gain produced through playback of an audio signal via listening device 130. The driving signal to the speaker can then be reduced using the equalization curve implemented by signal processing component 120 as a function of frequency in correspondence with amount of trapped volume insertion gain as indicated by the direct sensing of the sound pressure level within the sealed ear canal, thereby reducing trapped volume insertion gain and recovering a truer frequency response for the audio signal.

In exemplary embodiments, the feedback information provided by an internal microphone incorporated within listening device 130 to be located beyond an acoustic seal within a sealed ear canal could also be further utilized for performing additional functions. For example, the information sensed by the internal microphone could be utilized to determine when the acoustic seal provided by listening device 130 is degraded by analyzing the sensed information to identify drops in sound pressure level. Based on such a determination, system 100 can configured to perform an appropriate response, such as attenuation of the speaker or anti-feedback filtering. As another example, the internal microphone may also be utilized to monitor functions internal to the wearer. For instance, the feedback information provided by the internal microphone can be used to identify static or very low frequency pressure changes in the ear canal resulting from chewing, yawning, or insertion of the ear sealing device itself. Based on such information, system 100 can be configured to respond by allowing the imposition of a bias to the speaker of listening device 130 in order to compensate for the speaker load resulting from this pressure, thereby allowing the speaker to sound more like a free field speaker.

As another example of the use of the internal microphone to monitor functions internal to the wearer, the feedback information provided by the internal microphone may be used to identify soft vocalizations or coded communications produced by clicking of the teeth and thereby provide a valuable communication tool for military or law enforcement in situations where stealth is required. The feedback information provided by the internal microphone may also be used to monitor certain bodily functions that are audible in the ear canal, such as heart beats. Monitoring of heart rate in this manner can be used as an aid for exercise and physical training. In addition, for persons with heart conditions, this monitoring may be used to identify irregular heartbeat or a cessation of heartbeats indicative of a heart attack. System 100, upon identifying such a situation, can be configured to automatically sound an alarm or, if connected to (wirelessly or wired) or coupled with a communication device such as a mobile phone, configured to automatically call for emergency help, including providing location information via positioning functionality such as GPS in the communication device.

As an alternative example, such an internal microphone located beyond an acoustic seal within a sealed ear canal could be utilized, rather than for providing an automatic sensing and response mechanism that operates during playback of an audio signal, for implementing the indication of an amount of trapped volume insertion gain associated with an audio signal according to the particular characteristics of a corresponding listening device directly within the equalization curve employed by the signal processing component 120. In other words, in a manner similar to that described above in which an equalization curve was achieved through experimental analysis of the particular characteristics of the effects of a listening device on the acoustical compliance of a volume of air trapped between an acoustical seal of the listening device and the tympanic membrane, an equalization curve can be achieved through an experimental analysis of the sound pressure level for a particular listening device as directly sensed via use of the listening device in one or more representative situations when modified to incorporate an internal microphone as described above.

Accordingly, the equalization curve utilized by signal processing component 120 during audio playback can be implemented to minimize the trapped volume insertion gain based on the directly-sensed sound pressure levels during the experimental analysis when used in conjunction with non-modified versions of that particular model of listening device to perform equalization to scale back output of the audio signal at each frequency as it is being played in real time in the user's ear via listening device 130, thereby mitigating trapped volume insertion gain in the ear canal associated with the audio signal being played back in correspondence with the characteristics of that particular listening device.

While signal processing component 120 is illustrated as a separate, stand-alone audio signal processor in FIG. 2, in other exemplary embodiments of the present invention, signal processing component 120 can be configured for incorporation within audio signal generating device 110. For example, signal processing component 120 may be implemented within a suitable audio signal processing tool or utility as a plug-in, add-on, or extension supported by and installed within audio signal generating device 110. As used herein, the term "plug-in" can refer to a software application or module program, or one or more computer instructions, which may or may not be in communication with other software applications or modules, that interacts with a host application to provide specified functionality, and which may include any file, image, graphic, icon, audio, video, or any other attachment. In other exemplary embodiments, signal processing component 120 can be implemented as a standalone program that is run as a separate computer process, a portable application, a native component, a part of a software bundle, or any other suitable implementation.

In exemplary embodiments signal processing component 120 can be can be realized through any suitable hardware or software implementation or any suitable combination of hardware and software for performing the desired audio signal processing. In exemplary embodiments, signal processing component 120 can be implemented as an analog processing unit that operates directly on an electrical audio signal via suitable electrical circuitry or, in embodiments in which audio signal generating device 110 comprises a device such as a digital audio player that generates a digital representation of the audio signal for transmission to listening device 130, as a digital processing unit that operates mathematically on a digital representation of the audio signal via suitable digital circuitry such as, for example, a microprocessor.

In exemplary embodiments, system 100 can be implemented to utilize signal processing component 120 to perform the audio signal processing for mitigating effects of pneumatic pressure within the ear canal on an audio program that is used by audio signal generating device 110 to generate the audio signal transmitted to listening. In other words, in these exemplary embodiments, signal processing component 120 is used to premix the audio prior to playback rather than process the audio signal during playback.

In exemplary embodiments, signal processing component 120 can be configured to, in addition to performing audio signal processing on the audio signal being transmitted to listening device 130 for the purpose of reducing or mitigating trapped volume static pressure oscillations and the triggering of the acoustic reflex within the ear of the user, perform additional signal processing for altering harmonic content of the audio signal so that the human perception of loudness is maintained or increased while the trapped volume insertion gain in the sealed ear canal is being reduced or mitigated.

Figure 3:
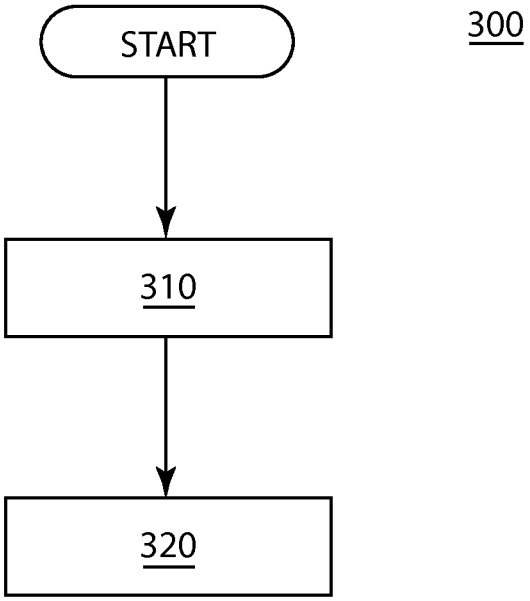
FIG. 3 is a flow diagram illustrating an exemplary embodiment of a process for mitigating effects of alternating or changing pneumatic pressures within a substantially sealed ear canal in accordance with an exemplary embodiment of the present invention.

Referring now to FIG. 3, a flow chart illustrating an exemplary embodiment of a process 300 for mitigating effects of alternating or changing pneumatic pressures within a substantially sealed ear canal in accordance with the present invention is provided. At block 310 of exemplary process 300, an indication of ear canal sound pressure level is provided that is associated with sound for an audio program produced by an audio listening device while substantially sealing an ear canal of a user to form a substantially trapped volume within the ear canal. At block 320, audio signal processing is performed on the audio program based on the indication of ear canal sound pressure level using a predetermined frequency response curve for the audio listening device to mitigate effects of pneumatic pressure within the ear canal.

In exemplary embodiments of the present invention, listening device 130 may comprise an over-ear device rather than an in-ear device. For example, listening device 130 may be closed-back circumaural or supra-aural headphones that may seal or substantially seal the ear canal when in use by a user. To the extent that such over-ear headphones fit snuggly to the sides of the head, they can also create a trapped volume or substantially trapped volume that is continuous with the ear canal in a manner similar to a sealed in-ear listening device. Sealed, or substantially sealed, over-ear headphones therefore can also subject the tympanic membrane to large amplitude static pressure oscillations resulting in over-excursions of the tympanic membrane. As used herein, the term "substantially seal" or "substantially trapped volume" means the degree of sealing, whether by manual movement of a listening device or by the use of a specially constructed seal, when harmful pneumatic pressures are created and impinge on the tympanic membrane. Thus, exemplary embodiments can be implemented to improve listener comfort and safety, as well as enhance sound quality, by incorporating an audio signal processing component along the audio signal flow from an audio signal generating device to such an over-ear listening device for reducing or mitigating trapped volume insertion gain.

Exemplary embodiments of the present invention may be implemented for hearing aids that seal in the user's ear, as such hearing aids produce the same undesirable trapped volume effects (high pressures and over-excursions of the tympanic membrane) as inset headphones. Exemplary embodiments of the present invention may also be implemented for devices such as professional in-ear monitors, high end insert headphones, or receiver in canal (RIC) hearing aids that uses a balanced armature transducer as a sound sources. In such a device, the open space on the front side of the diaphragm, but within the outer housing or case of the balanced armature transducer, is known as the Front Volume. When a device using one of these transducers (receivers) is sealed in the ear canal, the Front Volume is part of the trapped air volume which includes the sealed part of the ear canal.

Exemplary embodiments of the present invention may also be implemented for systems that are configured to combine functionality provided by different types of listening devices. For example, systems that combine the function of a hearing aid and a personal listening device such as an MP3 player or smartphone are detailed in related U.S. patent application Ser. No. 13/222,943 ("Patent Document 2"), the content of which is incorporated by reference thereto in its entirety herein. As described in Patent Document 2, embodiments of such systems can be implemented with a sound mixing and enhancement unit to allow the hearing impaired to enjoy music, make phone calls, and hear augmented sounds from their surroundings through the same in-ear coupling. In exemplary embodiments of the present invention that are implemented in conjunction with systems described in Patent Document 2, the sound mixing and enhancement unit utilized in such systems can be further implemented to incorporate a signal processing component that performs audio signal processing to mitigate or reduce trapped volume insertion gain in accordance with various embodiments of the present invention.

As further described in Patent Document 2, the systems disclosed therein can also be implemented for use by individuals with normal hearing. In these cases, the system incorporates hearing aid functionality that mixes in enough outside sound to provide the user with situational awareness while they are listening to music, talking on the phone, or otherwise consuming audio program material. The hearing aid functionality of the device will also be useful to non-hearing impaired users to boost the intelligibility of conversation in noisy environments, or utilize dynamic range compression, for instance to be able to hear soft dialog in a movie that has dramatically different sound pressure levels for loud and soft portions of the audio. The system may also provide the user with the ability to program the audio properties of this device themselves though a user interface provided by a smartphone, computer, tablet, or other device. In exemplary embodiments of the present invention that are implemented in conjunction with systems described in Patent Document 2, the user may be provided with the additional ability to control or modify, through such an interface, the equalization curve that is implemented by the signal processing component to perform audio signal processing for mitigating or reducing trapped volume insertion gain. For example, this ability may be provided via a graphic equalizer element that is provided by the user interface.

Exemplary embodiments of the present invention may also be implemented for systems similar to those described in Patent Document 2 in which the functionality of a hearing aid and a professional in-ear monitor are combined to thereby, in addition to performing functions of a hearing aid and of a high quality headphone that allows users to listen to music or other audio program material, also provide functionality that is typically specific to professional in-ear monitors. Many professional and semiprofessional musicians have some degree of hearing loss and need a hearing aid for everyday wear to allow them to distinguish speech and navigate their environment. They also, however, rely on professional quality audio in-ear monitors for studio work live performance. The characteristics of these two devices (hearing aid and professional in-ear monitor) are different and heretofore, have been mutually exclusive.

More specifically, the most significant difference between hearing aids and professional in-ear monitors is in frequency response. For good reasons, hearing aids have somewhat limited frequency response. They suppress, or "roll off" the frequencies below 250 to 400 Hz because these frequencies are not important to speech intelligibility, but frequently contain audio noise from engines, machinery, the wind, etc. Amplifying, through the normal operation of a hearing aid, this type of extraneous, low frequency noise can be disturbing to a hearing aid user and can mask higher frequency sounds that are more relevant to them. Additionally, hearing aids typically suppress audio signals above 6 to 8 kHz because these higher frequency signals can interfere with the intelligibility of speech. In contrast to hearing aids, high quality in-ear stage and studio audio monitors have good frequency response from 10 to 20 Hz at the low end to 15 to 20 kHz at the high. This is to allow high fidelity perception of bass content and high frequency harmonic content in music. Additionally, hearing aids typically employ considerably more dynamic range compression than in professional in-ear monitors. Hearing aids tend to compress audio signals over a wide range of decibels into a narrower range of volume (sound pressure level or SPL) at which it can be best heard by the hard of hearing user.

In exemplary embodiments of the present invention, a system that combines the functionalities of a hearing aid and a professional in-ear monitor can be provided in a manner similar to the systems described in Patent Document 2. When in hearing aid mode provides for a frequency response curve typical of hearing aids, so that the wearer is not subjected to amplified machine noise and has good speech intelligibility. While the listening device can take input from external devices such as cell phones, smart phones and MP3 players, in hearing aid mode the device primarily uses external microphones to provide ambient audio signals.

When switched to in-ear monitor mode, the same system can be used on stage or in the recording studio to allow the professional musician the full range of frequencies necessary to function at a high musical level. When the listening device is used as a professional in-ear monitor in this manner, the external hearing aid microphones may still be used, but the primary source of the audio signal will be wired or wireless connections to external audio feeds, for instance from a sound mixing console or from a device such as a body pack worn by the user. Additionally, when used as a professional in-ear monitor, the listening device still maintains some hearing aid functionality in that it can be customized to boost the amplitude of frequency ranges in which the wearer has a hearing deficiency. Some of these boosted frequency ranges may be outside the range (lower or higher) of frequencies typically considered when tailoring a hearing aid's frequency response for an average consumer, which requires a special more customization for the professional user, above what is done for a normal hearing aid consumer concerned mostly with voice intelligibility.

In exemplary embodiments, such a system can be implemented to provide at least two and potentially more channels or modes that store different audio programs each of which includes a frequency response (frequency specific equalization), a dynamic range (compression or expansion), and potentially other effects such as reverb. At least one of these programs is generally typical of the audio response of a hearing aid and at least one of these programs is typical of the audio response of a professional in ear monitor, perhaps enhanced in certain ways to compensate for the user's hearing deficiencies. The programming of the audio characteristics (frequency response, dynamic range, etc.) of the different channels for the inventive device may be done by an audiologist or sound engineer. Alternatively, the system can be implemented to allow for the user to modify or program the audio characteristics themselves (either for hearing aid or in-ear monitor functionality, or a combination of the two) by connecting the hearing aid/in-ear monitor to a computing device (for example, a computer, smart phone, or tablet computer) configured to enable this programming. The connection of the hearing aid/in-ear monitor to the computing device can be accomplished, for instance, using a cord of flex strip connector utilizing the data port on the device into which audiologists typically connect for the purpose of programming a hearing aid. In exemplary embodiments of such hearing aid/in-ear monitor hybrid system, signal processing strategies developed for hearing aids, such as feedback suppression and algorithms to enhance conversation intelligibility in noisy environments may be incorporated into audio program modes for both its hearing aid function and its in-ear monitor function. The various audio program modes may be implemented in such systems via sound mixing and enhancement unit that can be further implemented to incorporate a signal processing component that performs audio signal processing to mitigate or reduce trapped volume insertion gain in accordance with various embodiments of the present invention.

As described in related U.S. patent application Ser. No. 13/086,138 ("Patent Document 3"), the content of which is incorporated by reference thereto in its entirety herein, the detrimental effects of sealing a sound producing device in the ear canal can be mitigated by the use of an inflatable in-ear bubble-seal. Such a bubble provides a mechanism that operates similar to a pneumatic shock absorber that deforms or flexes to relieve some of the static pressure build up, produced by the motion of the speaker, which is responsible for static pressure oscillations and tympanic membrane over excursions. When the speaker diaphragm moves forward into the trapped volume of the ear canal, the light and flexible bubble seal can retract slightly to negate some of the volume change and reduce static pressure buildup.

In embodiments of an inflatable in-ear bubble-seal described in Patent Document 3, a slightly under-inflated bag-like structure made of a non-extensible material such as expanded polytetrafluoroethylene (ePTFE) is utilized performing this function. The inflatable bubble operates seal as a means for reducing trapped volume insertion gain, and for preventing, for example, insert headphones or hearing aids from triggering the stapedius reflex. The compliance of the inflatable bubble seal acts to partially or fully transform oscillating static pressures, which are high in amplitude (high SPL) and are 90 degrees out of phase with the velocity component of the sound waves, into normal sound waves which are lesser in amplitude and are more in phase with their velocity components.

Figure 4A:
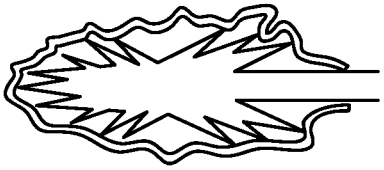
FIGS. 4*a* and 4*b* are diagrams illustrating exemplary embodiments of the present invention.
Figure 4B:
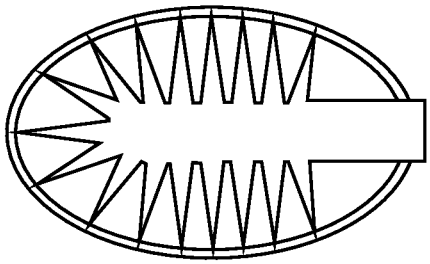

Referring now to FIGS. 4*a* and 4*b*, an exemplary embodiment of an in-ear bubble seal 400 in accordance with the present invention is illustrated. Exemplary bubble seal 400 is implemented to produce an acoustic seal in the ear that uses, rather than inflation via air pressure as previously disclosed, a soft, expanding internal structure 410 to enlarge the bubble. Bubble 400 can thus be incorporated within a listening device to lessen the impact of tympanic membrane over-excursions, oscillating static pressure in the ear canal, trapped volume insertion gain, and the constant triggering of the stapedius reflex.

As illustrated in FIG. 4, internal structure 410 consists of a spiny body in which the protruding spines are comprised of a soft material, such as a soft rubber like silicone rubber. Bubble 400 can be compressed for insertion into the ear canal as depicted in FIG. 4*a*, and, once inserted in the ear canal, internal structure 410 expands to push the outer skin 420 of the bubble against the walls of the ear canal as depicted in FIG. 4*b*, thus producing an acoustic seal. This structure still contains air inside the bubble surrounding the elements of the internal structure. Thus, it has similar acoustical properties to the inflatable bubble seal, such a flexible membrane seal that mitigates compliances (oscillating static pressure compressions) in the ear canal.

In the present exemplary embodiment, bubble 400 includes small apertures, or porosity, on its back hemisphere that faces out of the ear canal toward ambient air to allow for movement of air into and out of the bubble as it expands or compresses. In alternative exemplary embodiments, bubble 400 can include such small apertures, or porosity, on its front hemisphere that faces into the ear canal. In these embodiments, the air to inflate the bubble is drawn from the ear canal, thereby preventing the uncomfortable over-pressurization that may otherwise occur when a sealing device is pushed into the ear canal.

Aspects of exemplary embodiments of the present invention described herein can be implemented using one or more program modules and data storage units. As used herein, the terms "data storage unit," "data store", "storage unit", and the like can refer to any suitable memory device that may be used for storing data, including manual files, machine readable files, and databases. As used herein, the term "modules", "program modules", "components", "systems", "tools", "utilities", and the like include routines, programs, objects, components, data structures, and instructions, or instructions sets, and so forth that perform particular tasks or implement particular abstract data types. As can be appreciated, the modules refer to computer-related entities that can be implemented as software, hardware, firmware and/or other suitable components that provide the described functionality, and which may be loaded into memory of a machine embodying an exemplary embodiment of the present invention. Aspects of the modules may be written in a variety of programming languages, such as C, C++, Java, etc. The functionality provided by modules used for aspects of exemplary embodiments described herein can be combined and/or further partitioned.

The modules and/or storage units can all be implemented and run on the same computing system (for example, the exemplary computer system illustrated in FIG. 5 and described below) or they can be implemented and run on different computing systems. For example, one or modules can be implemented on a personal computer operated by a user while other modules can be implemented on a remote server and accessed via a network.

In the preceding description, for purposes of explanation, numerous specific details are set forth in order to provide a thorough understanding of the described exemplary embodiments. Nevertheless, one skilled in the art will appreciate that many other embodiments may be practiced without these specific details and structural, logical, and electrical changes may be made.

Some portions of the exemplary embodiments described above are presented in terms of algorithms and symbolic representations of operations on data bits within a processor-based system. The operations are those requiring physical manipulations of physical quantities. These quantities may take the form of electrical, magnetic, optical, or other physical signals capable of being stored, transferred, combined, compared, and otherwise manipulated, and are referred to, principally for reasons of common usage, as bits, values, elements, symbols, characters, terms, numbers, or the like. Nevertheless, it should be noted that all of these and similar terms are to be associated with the appropriate physical quantities and are merely convenient labels applied to these quantities. Unless specifically stated otherwise as apparent from the description, terms such as "executing" or "processing" or "computing" or "calculating" or "determining" or the like, may refer to the action and processes of a processor-based system, or similar electronic computing device, that manipulates and transforms data represented as physical quantities within the processor-based system's storage into other data similarly represented or other such information storage, transmission or display devices.

Exemplary embodiments of the present invention can be realized in hardware, software, or a combination of hardware and software. Exemplary embodiments can be realized in a centralized fashion in one computer system or in a distributed fashion where different elements are spread across several interconnected computer systems. Any kind of computer system—or other apparatus adapted for carrying out the methods described herein—is suited. A typical combination of hardware and software could be a general-purpose computer system with a computer program that, when being loaded and executed, controls the computer system such that it carries out the methods described herein.

Exemplary embodiments of the present invention can also be embedded in a computer program product, which comprises all the features enabling the implementation of the methods described herein, and which—when loaded in a computer system—is able to carry out these methods. Computer program means or computer program as used in the present invention indicates any expression, in any language, code or notation, of a set of instructions intended to cause a system having an information processing capability to perform a particular function either directly or after either or both of the following: (a) conversion to another language, code or, notation; and (b) reproduction in a different material form.

A computer system in which exemplary embodiments can be implemented may include, inter alia, one or more computers and at least a computer program product on a computer readable medium, allowing a computer system, to read data, instructions, messages or message packets, and other computer readable information from the computer readable medium. The computer readable medium may include non-volatile memory, such as ROM, Flash memory, Disk drive memory, CD-ROM, and other permanent storage. Additionally, a computer readable medium may include, for example, volatile storage such as RAM, buffers, cache memory, and network circuits. Furthermore, the computer readable medium may comprise computer readable information in a transitory state medium such as a network link and/or a network interface, including a wired network or a wireless network, that allow a computer system to read such computer readable information.

Figure 5:
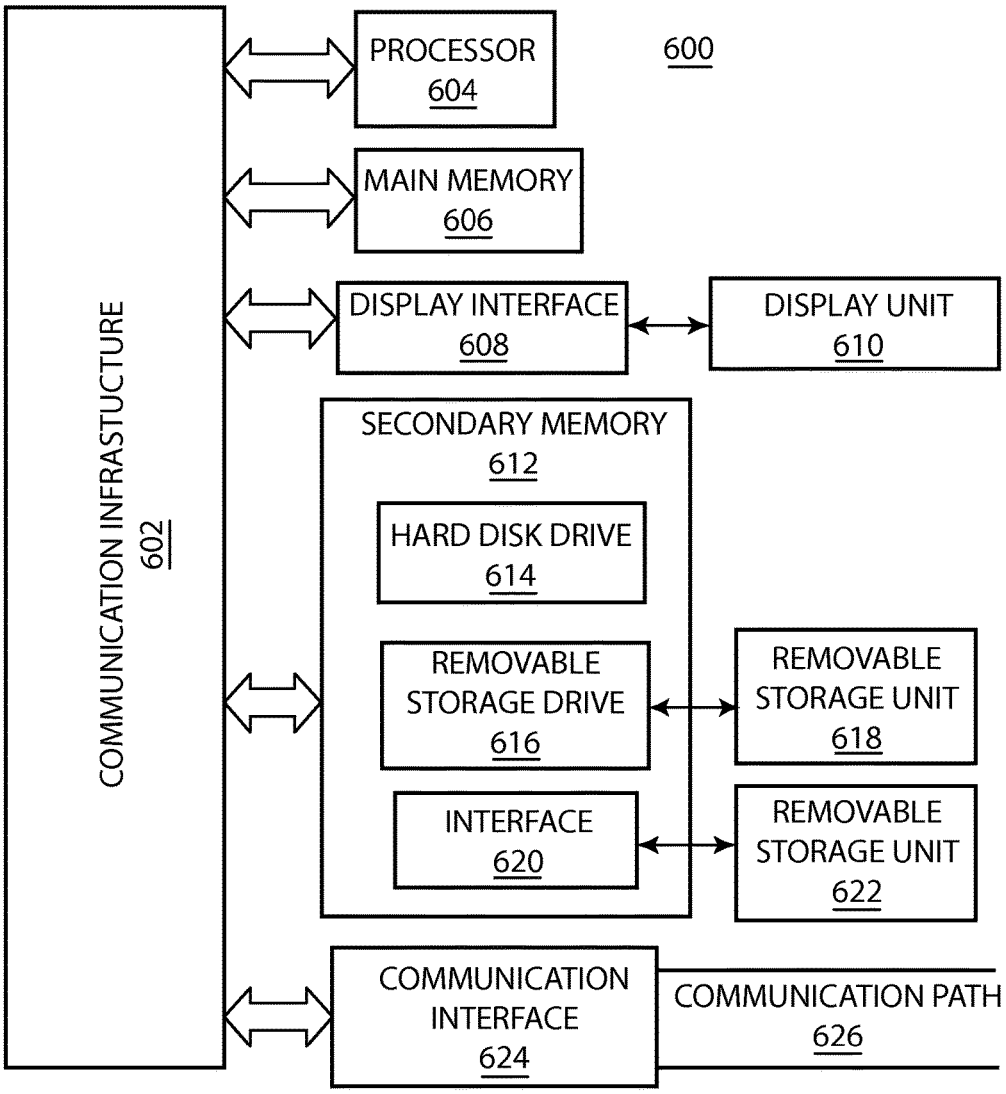
FIG. 5 is a block diagram of an exemplary computer system for implementing the present invention.

FIG. 5 is a block diagram of an exemplary computer system 600 that can be used for implementing exemplary embodiments of the present invention. Computer system 600 includes one or more processors, such as processor 604. Processor 604 is connected to a communication infrastructure 602 (for example, a communications bus, cross-over bar, or network). Various software embodiments are described in terms of this exemplary computer system. After reading this description, it will become apparent to a person of ordinary skill in the relevant art(s) how to implement the invention using other computer systems and/or computer architectures.

Exemplary computer system 600 can include a display interface 608 that forwards graphics, text, and other data from the communication infrastructure 602 (or from a frame buffer not shown) for display on a display unit 610. Computer system 600 also includes a main memory 606, which can be random access memory (RAM), and may also include a secondary memory 612. Secondary memory 612 may include, for example, a hard disk drive 614 and/or a removable storage drive 616, representing a floppy disk drive, a magnetic tape drive, an optical disk drive, etc. Removable storage drive 616 reads from and/or writes to a removable storage unit 618 in a manner well known to those having ordinary skill in the art. Removable storage unit 618, represents, for example, a floppy disk, magnetic tape, optical disk, etc. which is read by and written to by removable storage drive 616. As will be appreciated, removable storage unit 618 includes a computer usable storage medium having stored therein computer software and/or data.

In exemplary embodiments, secondary memory 612 may include other similar means for allowing computer programs or other instructions to be loaded into the computer system. Such means may include, for example, a removable storage unit 622 and an interface 620. Examples of such may include a program cartridge and cartridge interface (such as that found in video game devices), a removable memory chip (such as an EPROM, or PROM) and associated socket, and other removable storage units 622 and interfaces 620 which allow software and data to be transferred from the removable storage unit 622 to computer system 600.

Computer system 600 may also include a communications interface 624. Communications interface 624 allows software and data to be transferred between the computer system and external devices. Examples of communications interface 624 may include a modem, a network interface (such as an Ethernet card), a communications port, a PCMCIA slot and card, etc. Software and data transferred via communications interface 624 are in the form of signals which may be, for example, electronic, electromagnetic, optical, or other signals capable of being received by communications interface 624. These signals are provided to communications interface 624 via a communications path (that is, channel) 626. Channel 626 carries signals and may be implemented using wire or cable, fiber optics, a phone line, a cellular phone link, an RF link, and/or other communications channels.

In this document, the terms "computer program medium," "computer usable medium," and "computer readable medium" are used to generally refer to media such as main memory 606 and secondary memory 612, removable storage drive 616, a hard disk installed in hard disk drive 614, and signals. These computer program products are means for providing software to the computer system. The computer readable medium allows the computer system to read data, instructions, messages or message packets, and other computer readable information from the computer readable medium. The computer readable medium, for example, may include non-volatile memory, such as Floppy, ROM, Flash memory, Disk drive memory, CD-ROM, and other permanent storage. It can be used, for example, to transport information, such as data and computer instructions, between computer systems. Furthermore, the computer readable medium may comprise computer readable information in a transitory state medium such as a network link and/or a network interface including a wired network or a wireless network that allow a computer to read such computer readable information.

Computer programs (also called computer control logic) are stored in main memory 606 and/or secondary memory 612. Computer programs may also be received via communications interface 624. Such computer programs, when executed, can enable the computer system to perform the features of exemplary embodiments of the present invention as discussed herein. In particular, the computer programs, when executed, enable processor 604 to perform the features of computer system 600. Accordingly, such computer programs represent controllers of the computer system.

Although exemplary embodiments of the present invention have been described in detail, the present description is not intended to be exhaustive or limiting of the invention to the described embodiments. It should be understood that various changes, substitutions and alterations could be made thereto without departing from spirit and scope of the inventions as defined by the appended claims. Variations described for exemplary embodiments of the present invention can be realized in any combination desirable for each particular application. Thus particular limitations, and/or embodiment enhancements described herein, which may have particular advantages to a particular application, need not be used for all applications. Also, not all limitations need be implemented in methods, systems, and/or apparatuses including one or more concepts described with relation to exemplary embodiments of the present invention.

Therefore, it is intended that the invention not be limited to the particular embodiments disclosed presented herein, which were chosen and described to best explain the principles of the present invention and the practical application, and to enable others of ordinary skill in the art to understand the invention. It will be understood that those skilled in the art, both now and in the future, may make various modifications to the exemplary embodiments described herein without departing from the spirit and the scope of the present invention as set forth in the following claims, wherein reference to an element in the singular, such as by use of the article "a" or "an" is not intended to mean "one and only one" unless specifically so stated, but rather "one or more." Moreover, no claim element is to be construed under the provisions of 35 U.S.C. § 112, sixth paragraph, unless the element is expressly recited using the phrase "means for" or "step for." These following claims should be construed to maintain the proper protection for the present invention.

What is claimed is:

1. A method of mitigating effects of alternating or changing pneumatic pressures within a substantially sealed ear canal, the method comprising:

providing an indication of ear canal sound pressure levels associated with pneumatic pressures created within the ear canal that occur during playback of an audio program by a corresponding audio listening device that substantially seals the ear canal to form a substantially trapped volume within the ear canal;

transmitting an audio signal generated based on the audio program to the audio listening device for playback of the audio program by the audio listening device; and performing audio signal processing on the audio signal being transmitted to the audio listening device based on the indication of ear canal sound pressure levels using a predetermined frequency response curve that is determined according to characteristics of the audio listening device to reduce amplitudes of corresponding frequency components of the audio signal to mitigate pneumatic pressures within the substantially trapped volume of the ear canal during playback of the audio program by the audio listening device.

2. The method according to claim 1, wherein the audio signal processing is performed using a frequency dependent equalization curve implemented by an equalizer configured in terms of the audio listening device to scale output amplitude at each frequency in proportion to the indication of car canal sound pressure levels at the frequency.

3. The method according to claim 2, wherein the equalizer comprises a bank of nonlinear filters that perform audio signal processing for respective frequency components of the equalization curve.

4. The method according to claim 1, further comprising providing a model for analyzing the audio program to estimate increases in ear canal sound pressure levels as a function of frequency characteristics of the audio program, and wherein the indication of ear canal sound pressure levels is provided by using the model to analyze the audio program.

5. The method according to claim 4, wherein the model is provided based on characteristics of the audio listening device and an intended application of the audio listening device.

6. The method according to claim 5, wherein the model is provided based on predetermined values for a size of the substantially trapped volume and mechanical and acoustical properties of a middle ear structure.

7. The method according to claim 6, wherein the predetermined values for the mechanical and acoustical properties of a middle ear structure include values that are predefined based on a set of representative human measurements and/or values that are determined based on characteristics of a specific user of the corresponding audio listening device.

8. The method according to claim 1, further comprising providing the indication of ear canal sound pressure levels while the listening device is receiving the audio signal as an electrical audio signal generated for the audio program and converting the audio signal into a sound output.

9. The method according to claim 8, further comprising determining a degree of acoustical compliance in the ear canal by sensing impedance of a speaker of the audio listening device, and determining the indication of ear canal sound pressure levels according to an estimate of increases in ear canal sound pressure levels determined based on the degree of acoustical compliance in the ear.

10. The method according to claim 8, further comprising directly sensing sound pressure levels within the ear canal and providing an estimate of increases in ear canal sound pressure levels based on the degree of acoustical compliance in the ear as the indication of ear canal sound pressure levels.

11. A system for mitigating effects of alternating or changing pneumatic pressures within a substantially sealed ear canal, the system comprising:

an audio listening device configured to substantially seal an ear canal to form a substantially trapped volume within the ear canal and perform playback of an audio program by producing sound output for an audio signal that is generated based on the audio program and being transmitted to the audio listening device; and an audio signal processing component configured to perform audio signal processing on the audio signal being transmitted to the audio listening device based on an indication of car canal sound pressure levels associated with pneumatic pressures created within the substantially trapped volume of the ear canal that occur during playback of the audio program by the audio listening device using a predetermined frequency response curve that is determined according Co characteristics of the audio listening device to reduce amplitudes of corresponding frequency components of the audio signal to mitigate pneumatic pressures within the substantially trapped volume of the ear canal during playback of the audio program by the audio listening device.

12. A data processing apparatus, comprising:

at least one processor;

a random access memory for storing data and programs for execution by the at least one processor; and computer readable instructions stored in the random access memory for execution by the at least one processor to perform a method for mitigating effects of alternating or changing pneumatic pressures within a substantially sealed ear canal, the method comprising:

performing audio signal processing on an audio signal that is generated based on an audio program and being transmitted to an audio listening device that is configured to substantially seal an ear canal to form a substantially trapped volume within the ear canal and perform playback of the audio program by producing sound output for the audio signal, and wherein the audio signal processing is performed on the audio signal based on an indication of ear canal sound pressure levels associated with pneumatic pressures created within the substantially trapped volume of the ear canal that occur during playback of the audio program by the audio listening device using a predetermined frequency response curve that is determined according to characteristics of the audio listening device to reduce amplitudes of corresponding frequency components of the audio signal to mitigate pneumatic pressures within the substantially trapped volume of the ear canal.

* * * * *